United States Patent [19]

Bussjager

[11] Patent Number: 4,660,761

[45] Date of Patent: Apr. 28, 1987

[54] FLUE GAS HEAT PUMP

[75] Inventor: Rudy C. Bussjager, Chittenango, N.Y.

[73] Assignee: Carrier Corporation, Syracuse, N.Y.

[21] Appl. No.: 848,868

[22] Filed: Apr. 7, 1986

[51] Int. Cl.[4] ..... G05D 23/00

[52] U.S. Cl. ..... 237/2 B; 237/53

[58] Field of Search ..... 237/12.1, 2 B, 53, 110 B; 62/324.1, 238.6; 165/29

[56] References Cited

U.S. PATENT DOCUMENTS

| | | | |
|---|---|---|---|
| 2,266,238 | 12/1941 | Newton | 237/2 B |
| 4,141,490 | 2/1979 | Franchina | 237/2 B |
| 4,227,647 | 10/1980 | Eriksson | 237/2 B |
| 4,240,404 | 12/1980 | Franchina | 126/427 |
| 4,291,834 | 9/1981 | Palazzetti et al. | 237/12.1 |
| 4,503,912 | 3/1985 | Zolik | 165/47 |

*Primary Examiner*—Henry A. Bennet

*Attorney, Agent, or Firm*—Robert P. Sabath

[57] ABSTRACT

A flue gas heat pump is provided for extracting heat from the discharged hot flue gas of a furnace. The heat pump includes a condenser at the inlet of the furnace cabinet in heat transfer relation with the flow of air to be conditioned, and an evaporator disposed at the outlet of the furnace heat exchanger for extracting heat therefrom. A compressor is provided for compressing a refrigerant and delivering it to the heat exchangers. The compressor is located in the flow path of the air to be conditioned so that the heat generated by the compressor is transferred thereto.

10 Claims, 2 Drawing Figures

FLUE GAS HEAT PUMP

BACKGROUND OF THE INVENTION

The present invention relates to heating systems, and more particularly to a gas-fired furnace containing in the cabinet thereof a heat pump for transferring heat energy therewith.

There are many types of heating systems that perform a variety of functions and, in the process thereof, vent or discharge hot flue gases. For example, there are hot water systems for heating water for domestic or commercial use, wherein the discharged hot flue gases generated by the heating process are delivered to another apparatus that utilizes the heat energy of the hot flue gases for another purpose. A specific example of this type of system is a hot water boiler system in which the discharged hot flue gases are delivered to the heat exchanger of a separate furnace system to assist in heating return air from a space to be heated.

These furnace-type heating systems that attempt to utilize the heat energy of the hot flue gases have several disadvantages. One of these disadvantages is that the system is of large size and thus requires a large room or space for installation.

SUMMARY OF THE INVENTION

It is an object of the present invention to provide an improved heating system.

Another object of the present invention is to provide a heating system including a heat pump that is compact in size.

Yet another object of the present invention is to provide a heating system including a heat pump that can be easily installed with a pre-existing furnace.

A further object of the present invention is to provide a heating system including a heat pump that utilizes existing components of a furnace.

Further objects of the present invention will appear as the description proceeds.

In one form of the present invention there is provided a heating apparatus comprising a cabinet having therein an inlet, an outlet, and an air passage extending therebetween. A gas combustion chamber in the cabinet provides a heating fluid, and a heat exchanger located in the air passage delivers the heating fluid therethrough. To urge the heating fluid through the heat exchanger, an inducer fan is mounted in the cabinet and is connected to the heat exchanger for drawing the flow of heating fluid from the gas combustion chamber through the heat exchanger. In order to circulate air to be conditioned through the air passage, a blower is disposed in the air passage for circulating the air through the cabin inlet and across the heat exchanger in the air passage and then through the cabin outlet. A heat pump is provided in the cabinet for transferring heat therein, and includes a first heat exchanger in the air passage for transferring heat with the flow of air to be conditioned and a second heat exchanger in the cabinet for transferring heat with the heating fluid flowing through the heat exchanger.

BRIEF DESCRIPTION OF THE DRAWINGS

The above-mentioned and other features and objects of this invention, and the manner of attaining them, will become more apparent and the invention itself will be better understood by reference to the following description of an embodiment in conjunction with the drawings, wherein.

DESCRIPTION OF A PREFERRED EMBODIMENT

Figure 1:
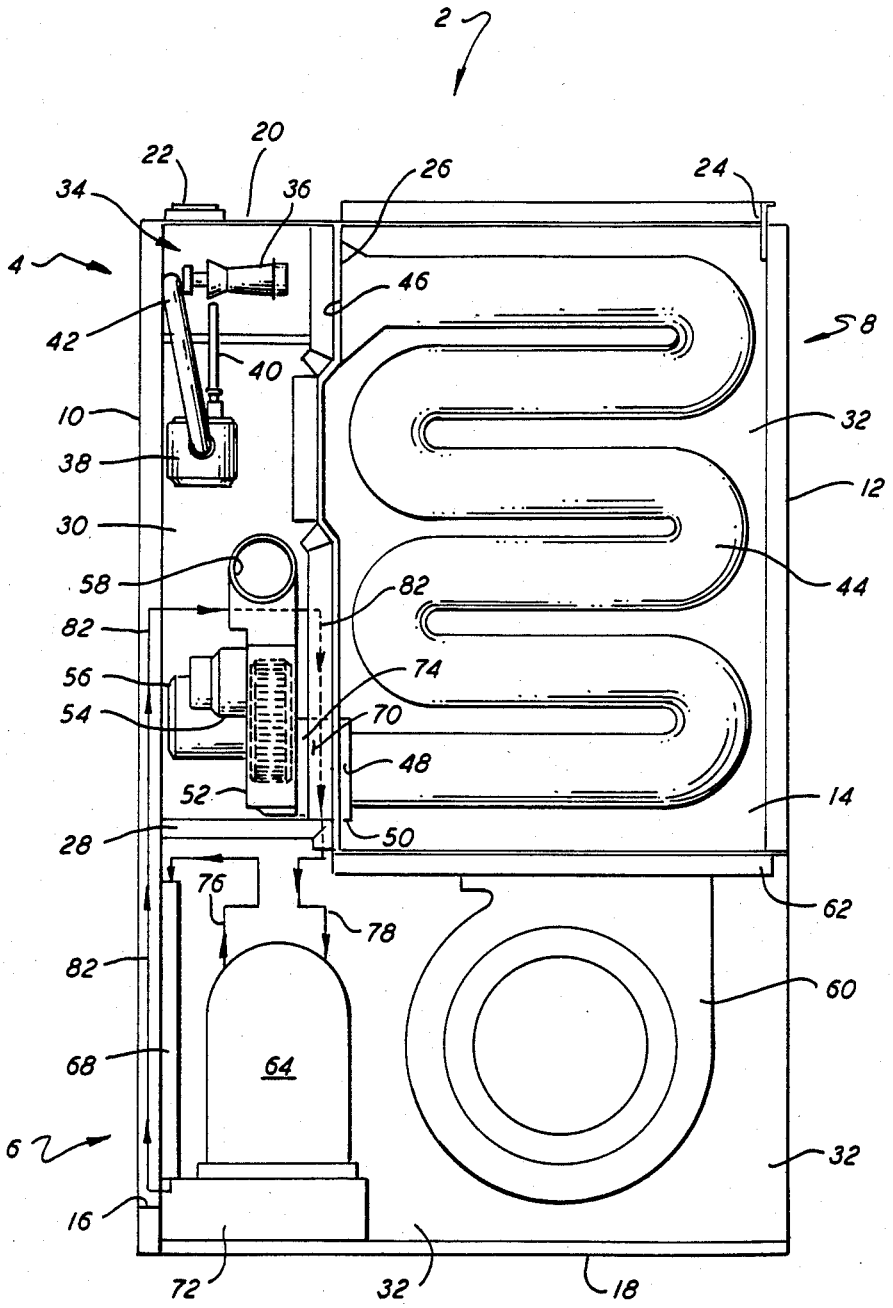
FIG. 1 a schematic of a heating system incorporating the principles of the present invention.

The use of the phrase "heat pump" herein is intended to define a system that transfers heat from a relatively low temperature reservoir to another reservoir at a higher temperature.

The present invention as illustrated in the single Figure has several advantages over existing heating systems. The present invention provides a flue gas heat pump system that is compact in size and thus easily installed in a minimum amount of space. In addition, the heat pump in the present invention is designed such that it can be easily installed with a pre-existing furnace. Furthermore, the present invention utilizes a single component for both the furnace and heat pump, such as the inducer motor and wheel. Finally, the furnace of the present invention can be either a condensing furnace or a noncondensing furnace.

Referring to the Figure, the heating system 2 of the present invention includes furnace 4 containing therein heat pump 6. Furnace 4 comprises a cabinet 8 formed by four side walls, only three of which are illustrated, side walls 10, 12, and 14, with side wall 10 having cabinet inlet 16 disposed in the bottom portion thereof. Bottom wall 18 closes the bottom of cabinet 8. Top wall 20 closes the top of cabinet 8, and has combustion air inlet 22 and cabinet outlet 24 disposed therein. Cabinet outlet 24 is adapted to have ducting (not shown) connected thereto and leading to the space or spaces to receive conditioned air.

Mounted within cabinet 8 is a vertically disposed partition 26 extending between side wall 14 and the opposite side wall (not shown) therefrom, and extending downwardly from top wall 20 to a central area within cabinet 8. Shelf 28 is mounted to side wall 10, sidewall 14, the sidewall opposite side wall 14, and to the bottom portion of partition 26, thereby defining enclosure 30. Also defined within cabinet 8 is air passage 32 extending between cabin inlet 16 and cabin outlet 24. Air passage 32 is composed of two portions, a horizontal portion and a vertical portion. The horizontal portion begins at cabin inlet 16 and is formed by bottom wall 18, the four side walls of cabinet 8 and shelf 28. The vertical portion of air passage 32 is formed by side wall 14, the side wall opposite side wall 14, side wall 12, partition 26, and leads through cabinet outlet 24 in top wall 20.

Mounted within enclosure 30 is gas burner assembly 34 including a plurality of inshot burners 36. A combustible gas is supplied to gas burner assembly 34 by gas regulator 38 through gas supply line 40 and gas manifold 42.

A plurality of heat exchangers 44 are mounted in the vertical portion of air passage 32 and have respective inlets 46 communicating with gas burner assembly 34 through a respective plurality of openings (not shown) in partition 26. Any number of inshot burners 36 and heat exchangers 44 can be used in furnace 4, however, for purposes of simplicity the remaining description will assume only one inshot burner 36 and one heat exchanger 44. Inshot burner 36 receives fuel gas from gas regulator 38 and injects the fuel gas into heat exchanger inlet 46. A part of the injection process includes drawing air into heat exchanger 44 so that the fuel gas and air mixture may be combusted therein.

Although heat exchanger 44 is illustrated as having a serpentine shape with six horizontal passes therethrough, any number of passes can be used. However, the shape of heat exchanger 44 is not considered part of the present invention.

Heat exchanger 44 includes an outlet 48 connected to a spacer duct 50 mounted in an opening (not shown) in partition 26. Inducer housing 52 is mounted within enclosure 30 and communicates with heat exchanger outlet 48. Inducer housing 52 houses inducer wheel 54 which is rotated by inducer motor 56. Housing 52 further includes a vent 58 which can be connected to a flue or chimney (not shown).

Circulating air blower 60 is mounted in air passage 32 at the juncture of the horizontal and vertical portions thereof, so that blower 60 is aligned with cabinet inlet 16 and cabinet outlet 24. Blower 60 can be mounted to heat exchanger 44, or a plate 62, which is mounted to the bottom portion of heat exchanger 44. Plate 62 does not obstruct the flow of air to be conditioned through air passage 32.

Cabinet 8 further contains heat pump 6 comprising compressor 64, condenser 68, evaporator 70, and associated piping.

Compressor 64 is mounted on a platform 72 so that it is in the flow of air to be conditioned flowing through cabinet inlet 16.

Condenser 68 is mounted either in or adjacent to cabinet inlet 16 so as to be in heat transfer relation with the air to be conditioned flowing through inlet 16.

Evaporator 70 is mounted to spacer duct 50 and a second spacer duct 74 so as to be in heat transfer relation with the heating fluid flowing through heat exchanger outlet 48.

Spacer duct 74 is connected to inducer housing 52 to provide the communication between housing 52 and heat exchanger 44.

Appropriate refrigeration lines are provided in heat pump 6. Discharge line 76 leads from compressor 64 to condenser 68, and suction line 78 leads from evaporator 70 to compressor 64. Refrigerant line 82 extends between heat exchanger 68, 70 and includes an appropriate expansion valve (not shown).

Heat exchangers 68, 70 can be of any design, but are preferably finned tube-type heat exchangers wherein the refrigerant flows through the tubes for transferring heat with a fluid flowing over the fins. Further, evaporator 70 can be made of or coated with a corrosion-resistant material to withstand the effects of any condensate formed at outlet 48. This is particularly preferable since evaporator 70 is condensing flue products.

In operation, when a heating load is detected, suitable controls start air blower 60 to begin a flow of air to be conditioned through inlet 16, air passage 32, and through outlet 24. Thereafter, inducer motor 56 is started to rotate inducer wheel 54 to draw combustion air through combustion air inlet 22 into gas burner assembly 34. About the same time, gas regulator 38 provides a flow of gas through manifold 42 to inshot burner 36, which combusts the mixture of combustion air and gas in heat exchanger inlet 46, thereby providing a heating fluid. This heating fluid is drawn through heat exchanger 44 by inducer wheel 54 and through heat exchanger outlet 48 into inducer housing 52. Thereafter, the flue gases exit vent 58 to a flue or chimney (not shown). Thus, the air to be heated flows through inlet 16 and across heat exchanger 44 in heat transfer relation therewith, and then through outlet 24 to the space to be heated.

Figure 2:
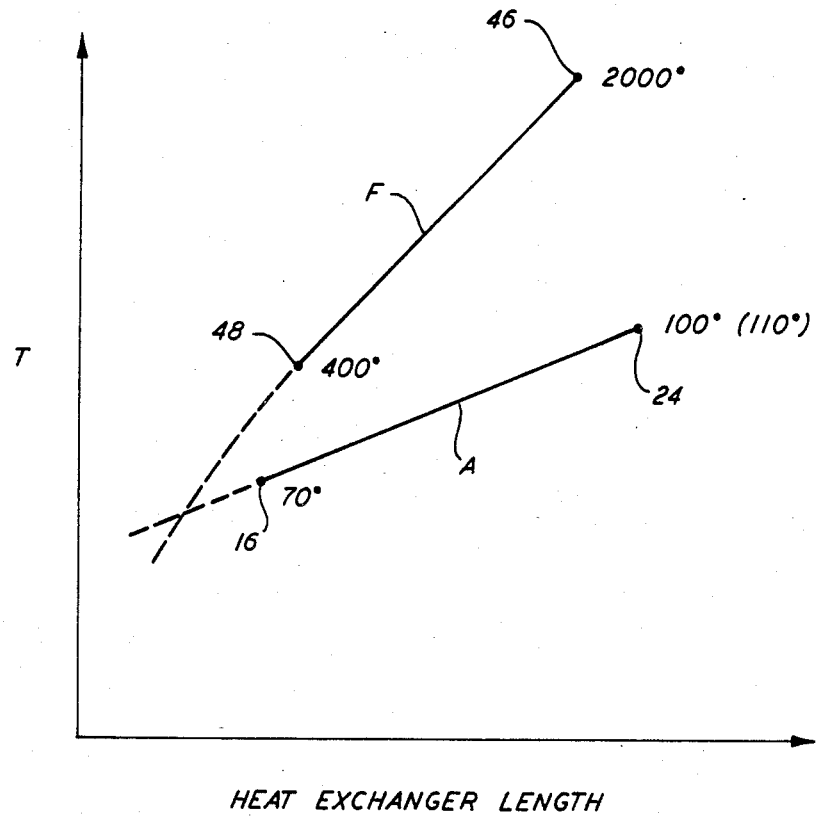
FIG. 2 is a graph helpful in explaining the increase in heating efficiency provided by the present invention.

This operation is graphically depicted in FIG. 2 wherein curve A represents the increase in temperature of the air to be heated and curve F represents the decrease in temperature of the flue gases. FIG. 2 is a graph of temperature versus heat exchanger length. As heat exchanger length is increased by adding further heat transfer surface or by other means having a similar effect, such as that provided by the present invention, the temperatures of the flue gases and air to be heated are decreased and increased, respectively. The temperature of the flue gas at heat exchanger inlet 46 (FIG. 2) is 2000° F., for example, and as the flue gas travels through heat exchanger 44, heat energy is transferred therefrom to the air to be heated. At heat exchanger outlet 48, the temperature of the flue gas is about 400° F.

Curve A indicates the increase in temperature of the air to be heated as it flows from inlet 16 to outlet 24 in heat transfer relation with heat exchanger 44. The temperature of the air to be heated has, for example, been increased from about 70° F. to about 100° F.

If additional heat, or preheating of the air to be heated is desired, then heat pump 6 is operated to provide a flow of refrigerant as indicated by the arrowheads on lines 76, 78, 82. Compressor 64 compresses gaseous refrigerant which is then delivered to condenser 68 to transfer heat energy to the air to be conditioned flowing through inlet 16, thereby condensing the refrigerant. The condensed refrigerant is then delivered through refrigerant line 82 and through the appropriate expansion valve to evaporator 70. In evaporator 70, the liquid refrigerant absorbs heat from the flue gas exiting through heat exchanger outlet 48, and the gaseous refrigerant created thereby is drawn through line 78 to compressor 64 to repeat the cycle. Note that compressor 64 is disposed between condenser 68 and air blower 60 so that the heat created by operation of compressor 64 is transferred to the air to be conditioned, thereby cooling compressor 64.

The addition of heat provided by heat pump 6 is graphically illustrated by the dotted line portions of curves F and A in FIG. 2. The dotted line extension of curve F illustrates the further transfer of heat energy from the flue gas to the refrigerant, thereby further decreasing the temperature of the flue gas. The dotted line portion of curve A illustrates the increase in heat energy of the air to be heated due to heat transfer between the refrigerant and the air. Although not illustrated, inlet 16 of curve A is now actually located at the far left end of the dotted line portion. The air enters inlet 16 at, for example, 70° F. and leaves outlet 24 at about 110° F. Thus, an increase in 10° has been realized by means of heat pump 6 transferring additional heat energy from the flue gas to the air. This results in heating efficiencies greater than 100%, wherein the heating efficiency is defined by the formula:

$$100\% \; X \frac{\text{heat energy transferred from flue gas}}{\text{energy supplied by combustion gas}}$$

based on 70° F. as the zero-enthalpy point.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which the invention pertains and fall within the limits of the appended claims.

What is claimed is:

1. A heating system, comprising:

a cabinet having an inlet, an outlet, and an air passage extending therebetween, a gas combustion means in said cabinet for providing a heating fluid, a heat exchanger means in said air passage for delivering a flow of the heating fluid therethrough, and including an intake opening connected to said gas combustion means and an exhaust opening, an inducer means in said cabinet and connected to said exhaust opening for drawing the flow of heating fluid through said heat exchanger means, a blower means in said air passage for circulating a flow of air to be conditioned through said inlet and said air passage across said heat exchanger means and through said outlet, and a heat pump means in said cabinet for transferring heat therein, said heat pump means including a first heat exchanger in said air passage and adjacent said inlet for transferring heat with the flow of air to be conditioned, and a second heat exchanger in said cabinet and at said exhaust opening of said heat exchanger means for transferring heat with the flow of heating fluid.

2. The system of claim 1 wherein said heat pump means further includes a compressor means in said cabinet and connected between said first and said second heat exchangers for drawing a refrigerant from said second heat exchanger, and for compressing and delivering the refrigerant to said first heat exchanger.

3. The system of claim 2 wherein said compressor means is disposed in said air passage upstream of said heat exchanger means.

4. The system of claim 2 wherein said compressor means is disposed in said air passage between said first heat exchanger and said blower means.

5. The system of claim 1 wherein said second heat exchanger is connected between said exhaust opening of said heat exchanger means and said inducer means.

6. In combination, a furnace including a cabinet having an inlet, an outlet, and an air passage therebetween, a combustion means in said cabinet for selectively providing a heating fluid, a heat exchanger means in said air passage for delivering a flow of a heat transfer fluid therethrough, and including an intake opening connected to said gas combustion means and an exhaust opening, an inducer means in said cabinet and connected to said exhaust opening for drawing the flow of heat transfer fluid through said heat exchanger means, and a blower means in said air passage for circulating a flow of air to be conditioned through said inlet and across said heat exchanger means in said air passage and through said outlet; and a heat pump for supplying additional heat, comprising:

a first heat exchanger in said air passage for transferring heat with the flow of air to be conditioned, a second heat exchanger in said cabinet and connected to said heat exchanger means for transferring heat with the flow of heat transfer fluid, and a compressor in said cabinet and connected between said first and said second heat exchangers.

7. The combination of claim 6 wherein said first heat exchanger is adjacent said inlet of said cabinet.

8. The combination of claim 6 wherein said second heat exchanger is connected between said exhaust opening of said heat exchanger means and said inducer means.

9. The system of claim 6 wherein said compressor is in said air passage.

10. The combination of claim 9 wherein said compressor is between said first heat exchanger and said blower means.

* * * * *